US005860814A

United States Patent [19]

Akama et al.

[11] Patent Number: 5,860,814

[45] **Date of Patent: *Jan. 19, 1999**

[54] ELECTRIC CONNECTOR FOR PRINTED CIRCUIT BOARD

[75] Inventors: Junichi Akama, Chigasaki; Manabu Shimizu, Kawasaki; Wataru Endoh, Yokohama; Kazuyuki Futaki, Suzaka, all of Japan

[73] Assignee: Fujitsu Takamisawa Component Limited, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 736,735

[22] Filed: Oct. 25, 1996

[30] Foreign Application Priority Data

Dec. 22, 1995 [JP] Japan ..... 7-334645

[51] Int. Cl.[6] ..... H01R 9/09

[52] U.S. Cl. ..... 439/74; 439/108

[58] Field of Search ..... 439/74, 83, 660, 439/101, 108

[56] References Cited

U.S. PATENT DOCUMENTS

| | | | |
|---|---|---|---|
| 4,762,500 | 8/1988 | Dola et al. | 439/83 |
| 5,161,987 | 11/1992 | Sinisi | 439/101 |
| 5,169,324 | 12/1992 | Lemke et al. | 439/108 |
| 5,181,855 | 1/1993 | Mosquera et al. | 439/74 |
| 5,542,851 | 8/1996 | Chikano et al. | 439/608 |
| 5,618,191 | 4/1997 | Chkano et al. | 439/608 |
| 5,626,482 | 5/1997 | Chan et al. | 439/74 |

FOREIGN PATENT DOCUMENTS

| | | |
|---|---|---|
| 63-158773 | 7/1988 | Japan . |
| 4-337268 | 11/1992 | Japan . |
| 5-082201 | 4/1993 | Japan . |

*Primary Examiner*—Steven L. Stephan
*Assistant Examiner*—T. C. Patel

[57] ABSTRACT

An electric connector for interconnecting printed circuit boards including a plug and a jack. Each of the plug and the jack includes an insulating housing including an insulating base and a pair of parallel external walls standing on the front surface of the insulating base. The jack further includes an insulating internal wall standing on the front surface of the insulating base which is parallel to, and in the middle of, a pair of the parallel walls. One embodiment of the present invention is a row of parallel blade signal contacts and a leaf spring ground contact arranged on the outer and the inner surfaces of each parallel wall of the plug, respectively, and a row of parallel leaf spring signal contacts and a blade ground contact arranged on the inner surface of each parallel wall and on each surface of the internal insulating wall of the jack, respectively. Each of the leaf signal contacts and the blade ground contact make an electric contact with the corresponding blade signal and leaf spring ground contact; respectively.

18 Claims, 4 Drawing Sheets

ELECTRIC CONNECTOR FOR PRINTED CIRCUIT BOARD

FIELD OF THE INVENTION

This invention relates to an electric connector interconnecting printed circuit boards, particularly to a surface mounting connector for the printed circuit boards.

DESCRIPTION OF THE PRIOR ART

A recent development of high-packing density in assembly on information processing equipment, such as personal computers, has been attended with double-sided mounted printed circuit boards as well as miniaturizing electronic parts thereon, in which connectors are widely employed to all electrical interconnections between printed circuit boards. FIG. 1A and 1B are cross-sectional views of a plug and a jack in a pair for a conventional connector, respectively. They are engaged with each other along an arrow. The plug 1 includes an insulating housing 11 (all shaded area) formed by molded resin having a plurality of blade signal contacts 12 and blade ground contacts 13, while a jack 2 includes an insulating housing 21 (all shaded area) also formed by molded resin having a plurality of leaf spring signal contacts 22 and leaf spring ground contacts 23, in which both a plurality of the leaf spring signal contacts 22 and a plurality of the leaf spring ground contacts 23 are arranged in two parallel rows, respectively, and then a plurality of the leaf spring ground contacts 23 are arranged between the two parallel rows of the leaf spring signal contacts. The signal contacts 12 and 22 in each of the plug 1 and the jack 2 in a pair face against the ground contacts 13 and 23, respectively. These parallel arrangements reduce a crosstalk between any neighboring signal contacts. The signal contacts 12 and the ground contacts 13 in the plug 1 are supported by each of flat walls 14, 15, and 16, and have terminals 17 and 18 which penetrate a throughhole 31 formed in each of the printed circuit boards 3 and 3' to be soldered with conducting patterns 32 and 32' at the back side. The signal contacts 22 and the ground contacts 23 in the jack 2 are separated by insulating internal walls 25. The terminals 17,18 in the plug and 27, 28 in the jack 2 penetrate a throughhole 31 formed in each of the printed circuit boards 3 and 3' to be soldered with conducting patterns 32 and 32' at the back side, respectively. Thus, interconnections of the signal contacts 12 with the signal contacts 22, and the ground contacts 13 with the ground contacts 23 are carried out simultaneously by engaging the plug 1 with jack 2. A high-speed signal transmission, for instance, whose signal frequency is as high as 100 MHz, needs further reduction of the crosstalk. However, since the conventional connector has an arrangement in which each of the ground contacts faces to the corresponding signal contact one by one and is electrically connected with the others by a conducting pattern on the back surface of the printed circuit board, the inductance of the ground contacts can not be reduced sufficiently. Further, since the conventional connector has a throughhole for every terminal of the contacts as well as two insulating internal walls in the jack, further reduction of spacing between the contacts is restricted. These structures hinder the redesign of the connector so as to be compatible to a surface mount.

SUMMARY OF THE INVENTION

An object of the present invention is to provide an electric connector consisting of a plug and a jack interconnecting printed circuit boards, which is capable of a high speed signal transmission by reducing a crosstalk and improving packing density. According to one embodiment of the present invention, packing density has been improved by arranging a plurality of parallel signal contacts on the outer surface and a spring ground contact on the inner surface of an insulating housing, respectively, and crosstalk has been reduced by arranging a row of parallel signal contacts in parallel to a monolithic ground contact to control the characteristic impedance of the connector. According to a further aspect of the present invention, terminals of every contacts are extended out of the side walls of the insulating housing so as to be soldered to the corresponding conducting pattern of circuits on the front surface of the printed circuit boards, construction of which enables a surface mounting connector.

BRIEF DESCRIPTION OF THE DRAWINGS

The present invention will be more apparent from the following description, when taken in conjunction with the accompanying drawings, in which.

DESCRIPTION OF THE PREFERRED EMBODIMENTS

Reference will now be made in detail to the preferred illustrated embodiments of the invention, examples of which are illustrated in the accompanying drawings. While the invention will be described in conjunction with the preferred illustrated embodiments, it will be understood that they are not intended to limit the invention to these embodiments. On the contrary, the invention is intended to cover alternatives, modifications and equivalents, which may be included within the spirit and scope of the invention as defined by the appended claims.

Figures 1A, 1B:
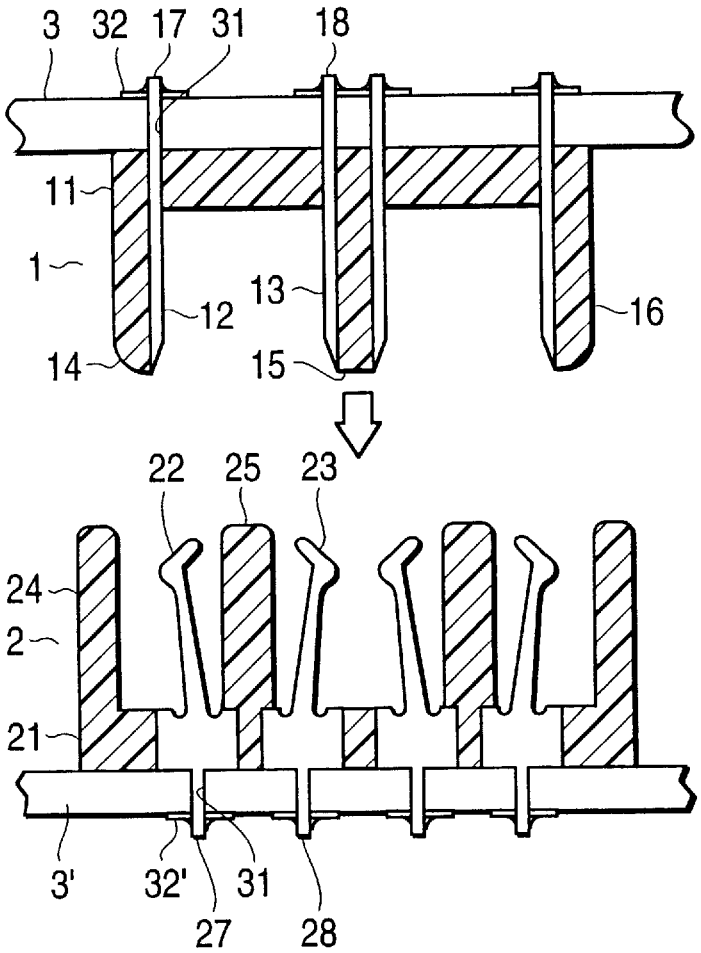
FIG. 1A PRIOR ART
FIG. 1B PRIOR ART
FIGS. 1A and 1B are cross-sectional views of a plug and a jack in a pair for a conventional connector, respectively.
Figures 2A, 2B:
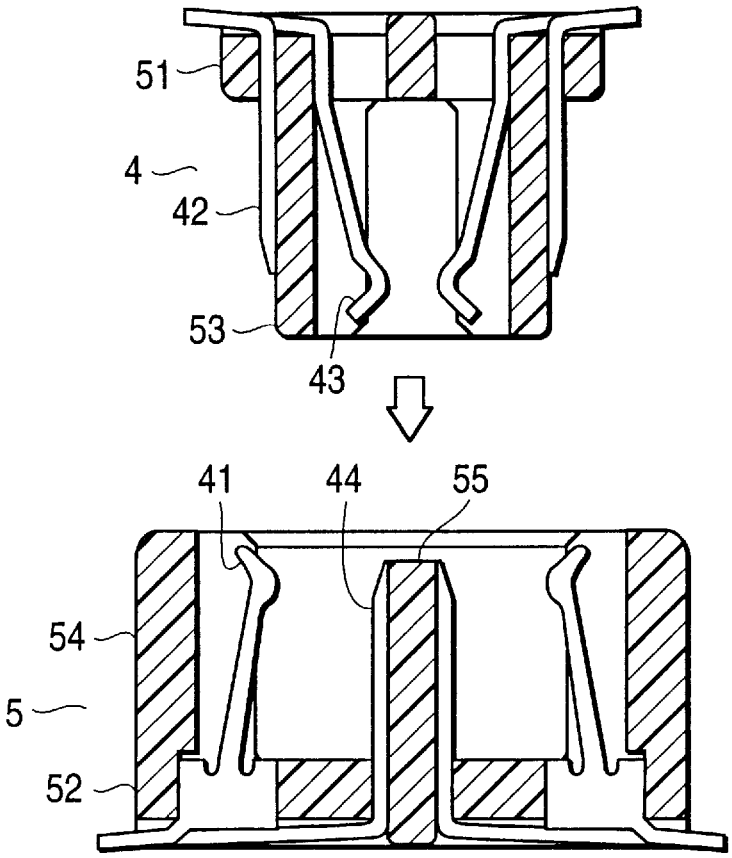
FIGS. 2A and 2B are cross-sectional views of a plug and a jack in a pair for a connector according to the present invention, respectively.

Referring to FIGS. 2A and 2B, the plug 4 and the jack 5 have molded housings 51 and 52, respectively, which are both made of resin. They easily engage with each other. The molded housing 51 of the plug 4 has an external wall 53 including at least a pair of parallel plates. A row of first leaf spring ground contacts 43 and a row of second blade signal contacts 42 are arranged on the inner and the outer surfaces of each of the parallel plates, respectively. Each of the parallel plates electrically insulates the signal contacts from the ground contacts. The molded housing 52 of the jack 5 has an external wall 54 including at least a pair of parallel plates and an internal wall 55 positioned in parallel to and in the middle of the parallel plates. There is no insulating internal wall between the signal contacts 41 and the ground contacts 44 in the jack unlike the prior work. A row of first spring signal contacts 41 and a row of second blade ground contacts 44 are arranged on the inner surface of each of the parallel plates of the external wall 54 and on each surface of the internal wall 55, respectively. Internal dimensions between the parallel plates of the external wall 54 and each surface of the internal wall 55, and shape and strength of the springs are determined such that each of the signal contacts and the ground contacts of the plug make an electric connection correctly with the corresponding contact of the jack when the plug and the jack are engaged with each other in two parallel rows with respect to each of them such that in each of the two parallel rows face to the ground contacts in the corresponding one of the two parallel rows. The insulating internal wall 55 could be omitted by arranging the blades 44 in back-to-back contact if the blades would be stiff enough not to be deformed at an engagement, which will make further reduction of a volume of the connector.

Figure 3A:
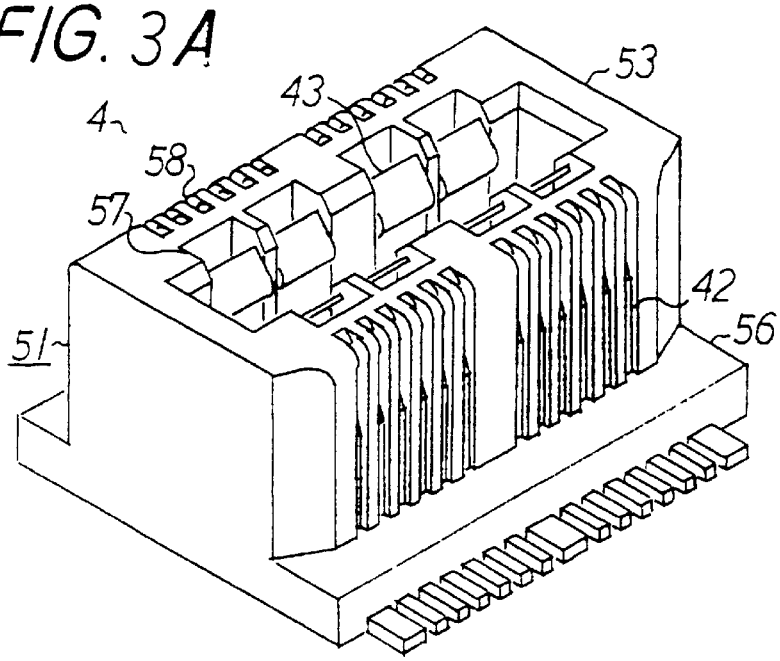
FIG. 3A is a perspective view of a plug for a connector according to the present invention.
Figure 3B:
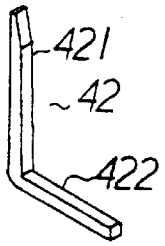
FIG. 3B is a perspective view of a blade signal contact of a plug for a connector according to the present invention.
Figure 3C:
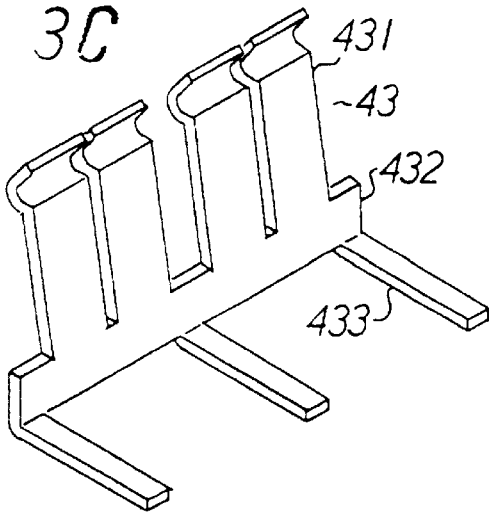
FIG. 3C is a perspective view of a leaf spring ground contact of a plug for a connector according to the present invention.

Referring to FIGS. 3 A through 3C, the plug 4 has a molded housing 51, blade signal contacts 42, and leaf spring ground contacts 43. Each of the blade signal contacts 42 consists of a contact part 421 and a terminal part 422, which are connected in an L-shape with each other. Each of the leaf spring ground contacts 43 consists of a plurality of contact part 431, a plurality of terminal part 433, and a common part 432 connecting the contact parts 431 with the terminal parts 433 at their roots. As shown in FIG. 3 A, each of the contact parts 431 of the leaf spring ground contacts 43 has such a width that it faces a plurality of the contact parts 421 of the blade signal contacts 42 in the housing 51. The terminal parts 433 are positioned in the boundaries between the contact parts 431 such that they are arranged in the middle or both ends of a row of the terminal parts 422 of the blade signal contacts 42 in the housing 51. The housing 51 of resin mold has a base 56 and an external wall 53 standing on the front surface of the base 56.

The external wall 53, which includes a pair of parallel parts, surrounds an area where the leaf spring ground contacts 43 are arranged. Each of the parallel parts has parallel grooves 57 for the leaf spring ground contacts 43 on the inner surface and parallel guides 58 for the blade signal contacts 42 on the outer surface. Since each of the blade signal contacts 42 has such narrow width that it may be easily bent sideways even if the root of the contact is assembled to the base 56 of the housing 51, the guides 58 formed on the outer surface of the external wall 53 hold the blade signal contacts 42 to prevent them from being bent sideways.

Figure 4A:
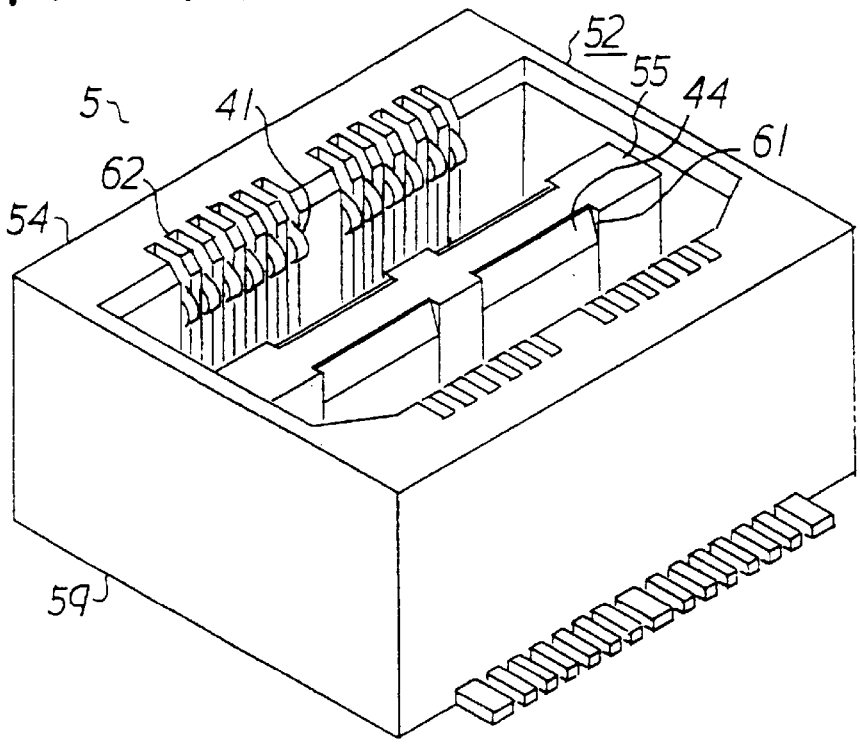
FIG. 4A is a perspective view of a jack for a connector according to the present invention.
Figure 4B:
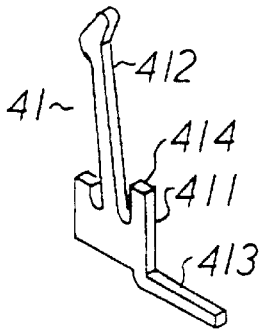
FIG. 4B is a perspective view of a leaf spring signal contact of a jack for a connector according to the present invention.
Figure 4C:
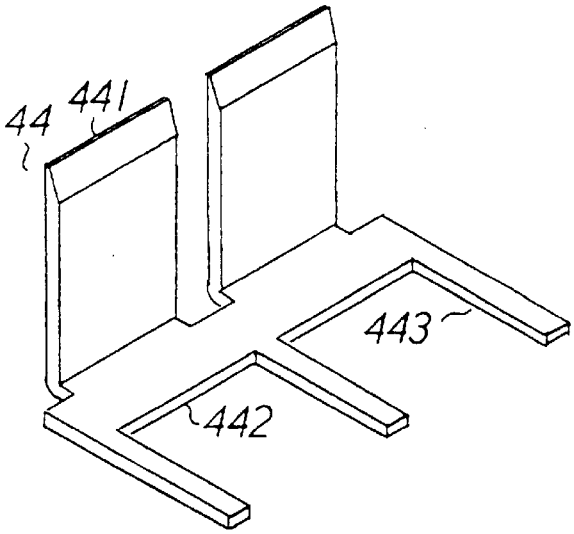
FIG. 4C is a perspective view of a blade ground contact of a jack for a connector according to the present invention.

Referring to FIG. 4A through 4C, the jack 5 has a molded housing 59, spring signal contacts 41, and blade ground contacts 44. The housing 59 has a base 59, an external wall 54 surrounding the periphery of the base which forms a hollow region to be engaged with the plug, and an insulating internal wall 55 dividing the hollow region into two. Each of the spring signal contacts 41 consists of a contact part 412, a terminal part 413, and a body 411 which connects the contact part 412 with the terminal part 413.

The body 411 is assembled in the base 54 to be fixed, and a bar 414 of the body 411 prevents the contact part 412 from bending sideways. While each of the blade ground contacts 44 consists of a plurality of wide contact parts 441, a plurality of terminal parts 443, and a common part 442 connecting the contact parts 441 with the terminal parts 443 at their roots. Each of the contact parts 441 has such a width that it faces to a row of the signal contact parts 412 in the housing 52 which are arranged with a certain spacing in each of the two parallel rows. The terminal parts 443 are positioned in the boundaries between the contact parts 441 such that they are arranged in the middle or both ends of a row of the terminal parts 413 of the spring signal contacts 41 in the housing 52. The insulating internal wall 55 of the housing 52 has parallel grooves 61 on the both sides where the blade ground contacts 44 are engaged. The external wall 54 has parallel guides 62 on the inter surface of the parallel parts for the spring signal contacts 41 to be engaged. Since each of the spring signal contacts 41 has such narrow width that it may be easily bent sideways even if the root 411 of the contact 412 is assembled to the base 59 of the housing 52, the guides 62 formed on the inter surface of the external wall 54 hold the spring signal contacts 41 to prevent them from being bent sideways. All terminals of both the plug and the jack are extended from the side walls of each mold in parallel to the surface of the base to be soldered to the corresponding conducting pattern ( not shown ) of a printed circuit board thereon. These terminal configurations enable a surface mounting connector for a printed circuit board.

A high speed data transmission with such a high frequency as about 100 MHz requires a low cross-talk between signal contacts and low characteristic impedance of the connector. This can be enabled by reducing inductance in a ground contact facing the nearest signal contacts. Since, according to the embodiment of the present invention, a plurality of the narrow parallel signal contacts arranged in a row face a wide monolithic contact part of the ground contact, and that the wide monolithic contact parts in a same ground contact are internally connected with each other by a common part, the internal inductance of the ground contact has been reduced sufficiently. As shown above, appropriate combinations of spring contacts and blade contacts in the plug and the jack reduce numbers of isolation walls of the molded housing to achieve miniaturization of the connector.

What is claimed is:

1. A plug of an electric connector for interconnecting two printed circuit boards comprising:

an insulating housing including a first insulating wall and an insulating base, the first insulating wall having first and second opposing surfaces, the insulating base having front and back opposing surfaces, wherein the first insulating wall stands on the front surface of the insulating base, and the back surface of the insulating base is to be fixed to one of the two printed circuit boards;

a plurality of arrays of first parallel signal contacts arranged on the first surface of the first insulating wall, the arrays being separated from each other on the first surface by a predetermined distance, each of the first parallel signal contacts having a terminal part on the back surface of the insulating base such that an end of the terminal part extends from a sidewall of the insulating base, the sidewall of the insulating base being parallel to, and on the same side of, the first surface of the first insulating wall; and a first monolithic ground contact arranged on the second surface of the first insulating wall, the first monolithic ground contact having a plurality of terminal parts on the back surface of the insulating base such that an end of each of the terminal parts extends from the same sidewall of the insulating base through the corresponding space between arrays of the first parallel signal contacts as the sidewall through which an end of the terminal part of each of the first parallel signal contacts extends, wherein both the end of each of the terminal parts of the first monolithic ground contact and the end of the terminal part of each of the first parallel signal contacts are on a plane parallel to the back surface of the insulating base.

2. A jack of an electric connector for interconnecting two printed circuit boards comprising:

an insulating housing including at least first and opposing second insulating walls and an insulating base, each of the first and the second insulating walls having first and second opposing surfaces, and the insulating base having front and back opposing surfaces, wherein the first and the second insulating walls stand on the front surface of the insulating base, the back surface of the insulating base is to be fixed to one of the two printed circuit boards, and the first and second insulating walls are arranged parallely such that the first surface of the second insulating wall faces the second surface of the first insulating wall, and that is spaced from the second surface of the first insulating wall such that a corresponding insulating wall of a plug is adapted to engage between the first and second insulating walls of the jack;

a plurality of arrays of second parallel signal contacts arranged on the second surface of the first insulating wall of the jack, the arrays being separated from each other by a space having a predetermined distance on the second surface, such that the second signal contacts of the jack make an electric contact with the corresponding signal contacts of the plug when the plug and the jack are engaged, each of the second parallel signal contacts having a terminal part on the back surface of the insulating base such that an end of the terminal part extends from a sidewall of the insulating base, the sidewall of the insulating base being parallel to and in the same side of the first surface of the first insulating wall; and a second monolithic ground contact arranged on the first surface of the second insulating wall, the second monolithic ground contact having a plurality of terminal parts on the back surface of the insulating base such that an end of each of the terminal parts extends from the same sidewall of the insulating base through the corresponding space between arrays of the second parallel signal contacts as the sidewall through which an end of the terminal part of each of the second parallel signal contacts extends, wherein both the end of each of the terminal parts of the second monolithic ground contact and the end of the terminal part of each of the second parallel signal contacts are on a plane parallel to the back surface of the insulating base.

3. An electric connector having a pair of a plug and a jack for interconnecting two printed circuit boards comprising:

an insulating housing of the plug including a first insulating wall and an insulating base, the first insulating wall having first and second opposing surfaces, the insulating base having front and back opposing surfaces, wherein the first insulating wall stands on the front surface, and the back surface is to be fixed to one of the two printed circuit boards;

an insulating housing of the jack including at least first and second opposing insulating walls and an insulating base, each of the first and second insulating walls having first and second opposing surfaces, and the insulating base having front and back opposing surfaces, wherein the first and second insulating walls stand on the front surface, the back surface is to be fixed to the other of the printed circuit boards, and the first and second insulating walls are arranged parallely such that the first surface of the second insulating wall faces the second surface of the first insulating wall, and that is spaced out as substantially apart from the second surface of the first insulating wall as the thickness of the first insulating wall of the plug such that the first insulating wall of the plug engages between the first and second insulating walls of the jack;

a plurality of arrays of first parallel signal contacts arranged on the first surface of the first insulating wall, the arrays being separated from each other on the first surface by a predetermined distance, each of the first parallel signal contacts having a terminal part on the back surface of the insulating base such that an end of the terminal part extends from a sidewall of the insulating base, the sidewall of the insulating base being parallel to, and on the same side of, the first surface of the first insulating wall of the plug;

a first monolithic ground contact arranged on the second surface of the first insulating wall, the first monolithic ground contact having a plurality of terminal parts on the back surface of the insulating base such that an end of each of the terminal parts extends from the same sidewall of the insulating base through the corresponding space between arrays of the first parallel signal contacts as the sidewall through which an end of the terminal part of each of the first parallel signal contacts extends, wherein both the end of each of the terminal parts of the first monolithic ground contact and the end of the terminal part of each of the first parallel signal contacts are on a plane parallel to the back surface of the insulating base of the plug;

a plurality of arrays of second parallel signal contacts arranged on the second surface of the first insulating wall of the jack, the arrays being separated from each other on the second surface by a predetermined distance, such that each of the second signal contacts of the jack makes an electric contact with the corresponding one of the first signal contacts of the plug when the plug and the jack are engaged, each of the second parallel signal contacts having a terminal part on the back surface of the insulating base such that an end of the terminal part extends from a sidewall of the insulating base, the sidewall of the insulating base being parallel to, and on the same side of, the first surface of the first insulating wall of the jack; and a second monolithic ground contact arranged on the first surface of the second insulating wall of the jack, the second monolithic ground contact having a plurality of terminal parts on the back surface of the insulating base such that an end of each of the terminal parts extends from the same sidewall of the insulating base through the corresponding space between arrays of the second parallel signal contacts as the sidewall from which an end of the terminal part of each of the second parallel signal contacts extends, wherein both the end of each of the terminal parts of the second monolithic ground contact and the end of the terminal part of each of the second parallel signal contacts are on a plane parallel to the back surface of the insulating base of the jack;

elasticity being supplied by either the first signal contacts of the plug or the second signal contacts of the jack, such that both of the first and second signal contacts maintain pressing each other to ensure an electric connection in each contact when the plug and the jack are engaged; and elasticity being supplied by either the first monolithic ground contact of the plug or the second monolithic ground contact of the jack, such that both of the first and second monolithic ground contacts maintain pressing each other to ensure an electric connection when the plug and the jack are engaged such that each of the plug and the jack has both spring and non-spring contacts therein.

4. The electric connector according to claim 3, further comprising:

a structure identical to a pair of the plug and the jack extending symmetrically with respect to a plane parallel to the first surface of the second insulating wall and that intersecting in the middle of the second insulating wall, wherein a plug has two identical first insulating walls, and a jack has two identical first insulating walls and such a symmetric second insulating wall that the second insulating wall has the second monolithic ground contact on each of both surfaces, and that is substantially as thick as the first insulating wall of the plug.

5. The electric connector according to claim 3, wherein the insulating housings are made of monolithic mold of resin.

6. The electric connector according to claim 4, further comprising;

a pair of insulating walls extending to both ends of the first insulating walls of the plug, perpendicular to the first insulating walls such that a continuous insulating wall surrounding a region between the first insulating walls is formed on the base of the plug;

a pair of insulating walls extending to both ends of the first insulating walls of the jack, perpendicular to the first insulating walls such that a continuous insulating wall surrounding a region between the first insulating walls including the second insulating wall is formed on the base of the jack; and wherein both ends of the second insulating wall are as apart from the inner surfaces of the pair of insulating walls of the jack as a thickness of the pair of insulating walls of the plug such that the continuous insulating wall of the plug engages the region surrounded by the continuous insulating wall of the jack.

7. The electric connector according to claim 3, wherein either the first signal contacts of the plug or the second signal contacts of the jack are blade signal contacts and the others are spring signal contacts engaging with the blade signal contacts, and either the first monolithic ground contact of the plug or the second monolithic ground contact of the jack is a blade ground contact and the others are leaf spring monolithic ground contacts engaging with the blade ground contacts.

8. The electric connector according to claim 7, wherein:

each of the blade signal contacts includes a blade contact part and a terminal part connected with the contact part in an L-shape;

each of the spring signal contacts includes a spring contact part, a terminal part and a body connecting the spring contact part with the terminal part at the root of the spring contact part, the terminal part being extended parallely to the back surface of the base;

the first monolithic ground contact includes a blade contact part, a terminal part, and a common part connecting the blade contact part with the terminal part, the terminal part being extended parallely to the back surface of the base; and the second monolithic ground contact includes a leaf spring ground contact part, a terminal part, and a common part connecting the leaf spring ground contact part with the terminal part, the terminal part being extended parallely to the back surface of the base.

9. The electric connector according to claim 8, wherein the first and second monolithic ground contacts have a plurality of the blade ground contact parts and leaf spring ground contact parts, respectively, a plurality of the blade ground contact parts being connected with each other at the roots by the common part, and a plurality of the leaf spring ground contact parts being connected with each other at the roots by the common part.

10. The electric connector according to claim 7, further comprising:

a bar being equipped in the body of the spring signal contact such that the bar assembled in the base to be fixed prevents the spring signal contact part from being bent sideways.

11. The electric connector according to claim 8, wherein the blade contact parts of a plurality of the blade signal contacts are arranged parallely side by side in a row, and that face parallely to the nearest blade ground contact part, the width of which is as wide as the row of the faced blade signal contacts when the plug and the jack are engaged.

12. The electric connector according to claim 8, wherein the terminal parts of either the blade signal contacts or the spring signal contacts and the terminal parts of either the first monolithic ground contact or the second monolithic ground contact which are nearest to either the blade signal contacts or the spring signal contacts are parallely stuck out of the same side wall of the base such that the stuck-out terminal parts are electrically connected with circuits on either of the two printed circuit boards.

13. The electric connector according to claim 12, wherein each of the stuck-out terminal parts of either the first monolithic ground contact or the second monolithic ground contact is arranged between two neighboring stuck-out terminal parts of either the parallel blade signal contacts or the parallel spring signal contacts and at both ends of the row of either the parallel blade signal contacts or the parallel spring signal contacts on the same side wall.

14. The electric connector according to claim 4, wherein either the first signal contacts and the first monolithic ground contacts of the plug are the blade signal contacts and the blade ground contacts, respectively, or the spring signal contacts and the leaf spring monolithic ground contacts, respectively.

15. The electric connector according to claim 4, wherein either the first signal contacts and the first monolithic ground contacts of the plug are the blade signal contacts and the leaf spring ground contacts, respectively, or the spring signal contacts and the blade monolithic ground contacts, respectively.

16. An electric connector including a plug and a jack to be engaged with each other, the electric connector comprising:

an insulating housing for each of the plug and the jack, the insulating housing including an insulating base having front and back opposing surfaces and an insulating external wall having a pair of parallel parts therein, the insulating external wall standing on the front surface of the insulating base;

an insulating internal wall standing on the front surface of the insulating base of the jack, the insulating internal wall being parallel to, and in the middle of, a pair of the parallel parts;

a plurality of arrays of parallel blade signal contacts arranged on each outer surface of the parallel parts of the plug, and being perpendicular to the front surface of the insulating base, the arrays being separated from each other on the outer surface by a predetermined distance, each of the parallel blade signal contacts having a terminal part on the back surface of the insulating base such that an end of the terminal part extends from a sidewall of the insulating base, the sidewall of the insulating base being parallel to, and on the same side of, the outer surface of the parallel parts of the plug;

a leaf spring ground contact arranged on each inner surface of the parallel parts of the plug, the leaf spring ground contact having a plurality of terminal parts on the back surface of the insulating base such that an end of each of the terminal parts extends from the same sidewall of the insulating base through the corresponding space between arrays of the parallel blade signal contacts as the sidewall through which an end of the terminal part of each of the parallel blade signal contacts extends, wherein both the end of each of the terminal parts of the leaf spring around contact and the end of the terminal part of each of the parallel blade signal contacts are on a plane parallel to the back surface of the insulating base of the plug;

a plurality of arrays of parallel leaf spring signal contacts arranged on each inner surface of the parallel parts of the jack, the arrays being separated from each other on the inner spring surface by a predetermined distance, such that each of the parallel leaf spring signal contacts makes an electric contact with the corresponding blade signal contact of the plug when the plug engages with the jack, each of the parallel leaf spring signal contacts having a terminal part on the back surface of the insulating base such that an end of the terminal part extends from a sidewall of the insulating base, the sidewall of the insulating base being parallel to, and on the same side of, the inner surface of the parallel parts of the jack; and a blade ground contact arranged on each of the both surfaces of the internal insulating wall, the blade ground contact having a plurality of terminal parts on the back surface of the insulating base such that an end of each of the terminal parts extends from the same sidewall of the insulating base through the corresponding space between arrays of the parallel leaf spring signal contacts as the sidewall from which an end of the terminal part of each of the parallel leaf spring signal contacts extends, wherein both the end of each of the terminal parts of the blade ground contact and the end of the terminal part of each of the parallel leaf spring signal contacts are on a plane parallel to the back surface of the insulating base of the jack.

17. The electric connector according to claim 16, further comprising:

a row of parallel grooves formed on each outer surface of the parallel parts of the plug, in which the blade signal contacts are arranged to prevent the blade signal contacts from being bent sideways when the plug engages with the jack;

a row of parallel grooves formed on each inner surface of the parallel parts of the jack, in which the leaf spring signal contacts are arranged to prevent the leaf spring signal contacts from being bent sideways when the plug engages with the jack;

a groove formed on each inner surface of the parallel parts of the plug, in which the leaf spring ground contact is arranged; and a groove formed on each of the both surfaces of the internal insulating wall of the jack, in which the blade ground contact is arranged such that the blade ground contact faces parallely to the nearest row of the blade signal contacts to decrease an electric coupling between the blade signal contacts.

18. The electric connector according to claim 16, wherein each of the terminals are soldered with the corresponding conducting pattern of circuits on printed circuit boards.

* * * * *

UNITED STATES PATENT AND TRADEMARK OFFICE

CERTIFICATE OF CORRECTION

PATENT NO.: 5,860,814
DATED : January 19, 1999
INVENTOR(S): Junichi AKAMA et al.

It is certified that error appears in the above-identified patent and that said Letters Patent is hereby corrected as shown below:

On the title page, [56] References Cited, line 7, change "Chkano" to --Chikano--.

Col. 3, line 25, change "part" (both occurrences) to --parts--;
lines 57-58, delete the paragraph break.

Signed and Sealed this

Twentieth Day of July, 1999

*Attest:*

*Attesting Officer*

Q. TODD DICKINSON

*Acting Commissioner of Patents and Trademarks*